US005331531A

United States Patent [19]

Unger et al.

[11] Patent Number: 5,331,531

[45] Date of Patent: Jul. 19, 1994

[54] MOUNTING ARRANGEMENT FOR RECESSED LIGHTING FIXTURES

[75] Inventors: Helmut K. Unger, Menden, Fed. Rep. of Germany; Ludwig Gabrecht, deceased, late of Wickede, Fed. Rep. of Germany, by Inge Gabrecht, administrator

[73] Assignee: Wila Leuchten GmbH, Fed. Rep. of Germany

[21] Appl. No.: 59,469

[22] Filed: May 11, 1993

[30] Foreign Application Priority Data

May 13, 1992 [DE] Fed. Rep. of Germany ..... 4215652

[51] Int. Cl.[5] ..... F21S 1/02

[52] U.S. Cl. ..... 362/365; 362/147; 362/289; 362/371; 411/344

[58] Field of Search ..... 362/147, 364, 365, 366, 362/368, 370, 371, 287, 289, 427; 411/340, 341, 342, 344, 345

[56] References Cited

U.S. PATENT DOCUMENTS

| | | | |
|---|---|---|---|
| 1,775,665 | 9/1930 | Behm | 411/340 |
| 2,908,196 | 10/1959 | Apfelzweig | 411/344 |
| 2,950,141 | 8/1960 | Koff | 411/340 |
| 4,048,491 | 9/1977 | Wessman | 362/364 |
| 4,457,653 | 7/1984 | Leib | 411/344 |
| 5,077,650 | 12/1991 | Cestari | 362/368 |

FOREIGN PATENT DOCUMENTS

| | | |
|---|---|---|
| 2915545 | 4/1979 | Fed. Rep. of Germany . |
| 4016531 | 5/1990 | Fed. Rep. of Germany . |
| 4030077 | 9/1990 | Fed. Rep. of Germany . |

*Primary Examiner*—Ira S. Lazarus
*Assistant Examiner*—Y. Quach
*Attorney, Agent, or Firm*—Feiereisen & Kueffner

[57] ABSTRACT

A mounting arrangement for recessed lighting fixtures, includes a mounting ring with a cylindrical wall section for insertion in a ceiling opening. The mounting ring is provided with several holding elements, each of which being adjustable by a spindle between a first position in which the mounting ring is insertable in the ceiling opening and a second position in which the mounting ring is securely retained in the ceiling opening. Each holding element includes an angle plate received in a compartment of the mounting ring and having a short leg and a long leg. The angle plate is rotatably supported about a bolt which extends in the vertex of the angle plate and is connected to the spindle. Upon insertion of the mounting ring in the ceiling opening, the holding element occupies its first or upper position, with the long leg extending coextensive with the spindle and with the short leg being supported by the top edge of a rear wall of the compartment. Upon rotation of the spindle, the holding element is moved downwards and is pivoted into the second position, with the short leg bearing upon the inside surface of the rear wall and with the long leg radially projecting outwards to bear upon the edge of the ceiling plate.

8 Claims, 3 Drawing Sheets

Fig. 4
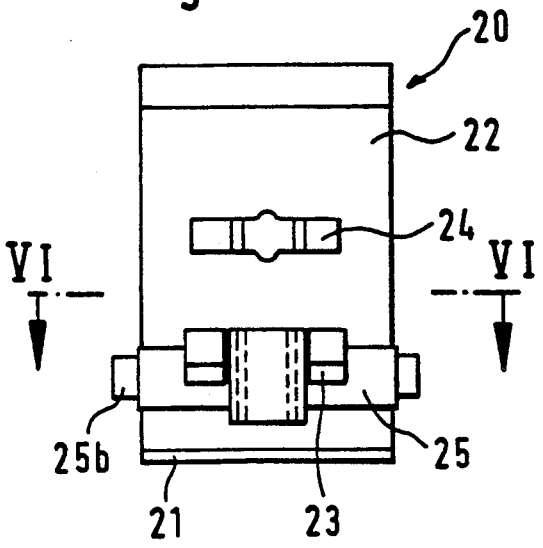
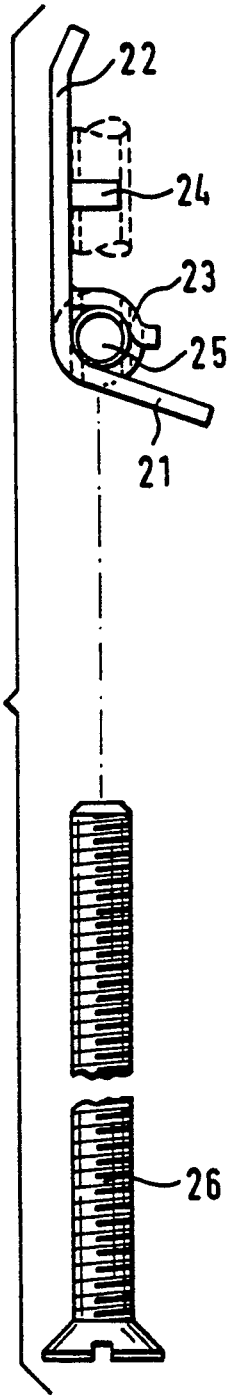
Fig. 5
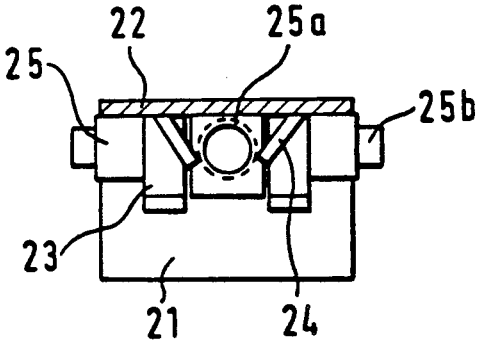
Fig. 6

MOUNTING ARRANGEMENT FOR RECESSED LIGHTING FIXTURES

BACKGROUND OF THE INVENTION

The present invention refers to a mounting arrangement for recessed lighting fixtures, and in particular to a mounting arrangement of the type including a mounting ring of plastic material for insertion in a ceiling opening and at least one holding element acted upon by a spindle for shifting the holding element from a first position in which a placement of the mounting ring in the ceiling opening is allowed and a second position in which the mounting ring is securely fixed in the ceiling opening.

Upon installation of a recessed lighting fixture, the mounting ring is initially inserted in a respective opening of the ceiling plate and then secured. Subsequently, the lighting fixture is attached to the mounting ring by means of fasteners and supports which are part of the mounting ring.

German publication no. DE-OS 40 30 077 describes a mounting ring which is attached in the ceiling opening by several circumferentially spaced retainer arms which radially project from the ring to bear upon the ceiling plate and are tightly secured from below by spindles that are received in semi-circular compartments. In order to allow insertion of the mounting ring in the ceiling opening, the retainer arms can be shifted above the compartments in a tangential position so as to prevent them from projecting radially outwards. When the spindles are then rotated, the retainer arms automatically swing through thread friction from the tangential position by 90° into a radial position in which the retainer arms are held by stops so that a further rotation of the spindles moves the retainer arms downwards until they bear upon the ceiling plate.

SUMMARY OF THE INVENTION

It is an object of the present invention to provide an improved mounting arrangement for recessed lighting fixtures which is universally applicable and is effectively secured independent of any thread friction.

This object and others which will become apparent hereinafter are attained in accordance with the present invention by providing the holding element in form of an angle plate with a short leg and a long leg, with the angle plate being received in a compartment of the mounting ring and supporting in the vertex a bolt which receives the spindle, wherein in the initial assembly position of the holding element the angle plate is oriented about the bolt such that the long leg extends vertically so as to be coextensive with the spindle and the short leg is supported by the top edge of a rear wall of the compartment and wherein in the fastening position of the holding element the angle plate is pivoted about the bolt such that the short leg bears against the inside of the rear wall and the long leg projects radially outwards to effect a securement of the mounting ring.

Suitably, the bolt is supported in an axle box in form of bushings which are secured to the angle plate. For accurately guiding the spindle, the long leg of the angle plate is provided with locking elements in form of slanted lugs between which the spindle is clamped when the holding element occupies its assembly position.

By providing the holding element in form of an angle plate which moves downwards during rotation of the spindle, with the long leg of the angle plate projecting radially outwards, the securement of the mounting ring is carried out in a simple and very effective manner without resorting to frictional forces in the thread. Upon insertion of the mounting ring in the ceiling opening, the angle plate occupies the upper assembly position, with the long leg oriented perpendicular and extending essentially in the area of the compartment. In this assembly position, the mounting arrangement is devoid of any outwardly projecting parts which could interfere with the insertion of the mounting ring through the ceiling opening. After placing the mounting ring inside the ceiling opening, the spindle is rotated so that the angle plate tilts automatically by about 90° through form-fit with the long leg now radially projecting outwards for securement of the mounting ring. The shift from the initial assembly position into the second fastening position is thus attained automatically independent from frictional forces in the thread.

The holding element according to the present invention can be used in connection with mounting rings of different diameter, i.e. relatively small and great diameters.

BRIEF DESCRIPTION OF THE DRAWING

The above and other objects, features and advantages of the present invention will now be described in more detail with reference to the accompanying drawing in which:

FIG. 4 is a partially sectional view, on an enlarged scale, of a holding element for use with a mounting ring;

FIG. 5 is a partially exploded side view of the holding element of FIG. 4;

FIG. 6 is a top view of the holding element of FIG. 4;

DETAILED DESCRIPTION OF PREFERRED EMBODIMENTS

Figure 1:
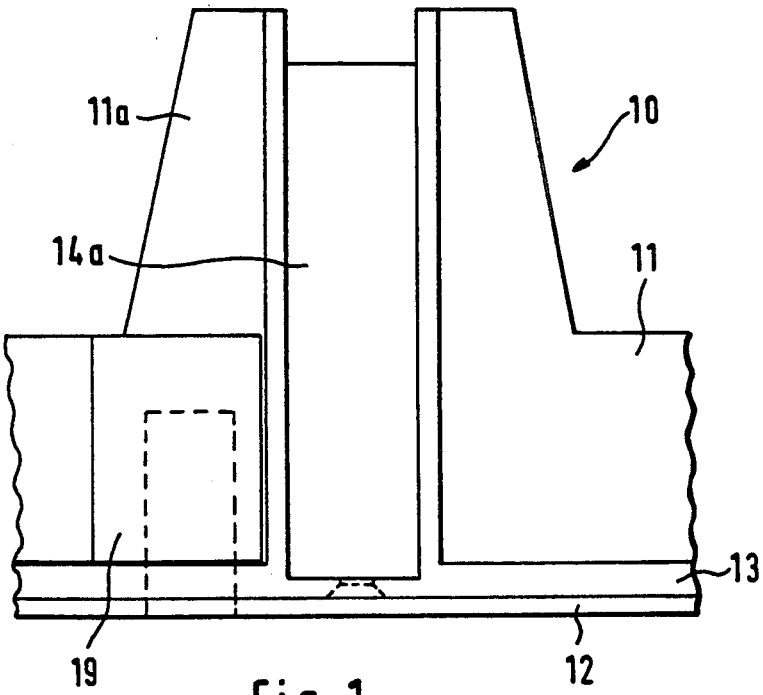
FIG. 1 is a fragmentary plan view in radial direction upon a mounting ring according to the present invention, without illustration of a holding element.

Throughout all the Figures, the same or corresponding elements are always indicated by the same reference numerals.

Figure 3:
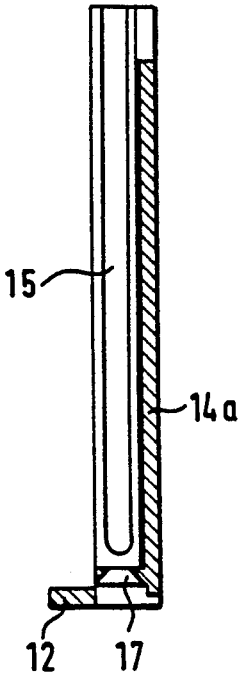
FIG. 3 is a sectional view taken along the line III—III in FIG. 2.

Referring now to the drawing and in particular to FIG. 1, there is shown a fragmentary plan view in radial direction upon a mounting ring according to the present invention, generally designated by reference numeral 10. The mounting ring 10 is a molded part of plastic material or metal and is of substantially cylindrical configuration with a cylindrical wall section 11. At its lower end, the wall section 11 is provided with a projection 12 which extends perpendicular from the wall section 11, as best seen in FIG. 3.

Figure 2:
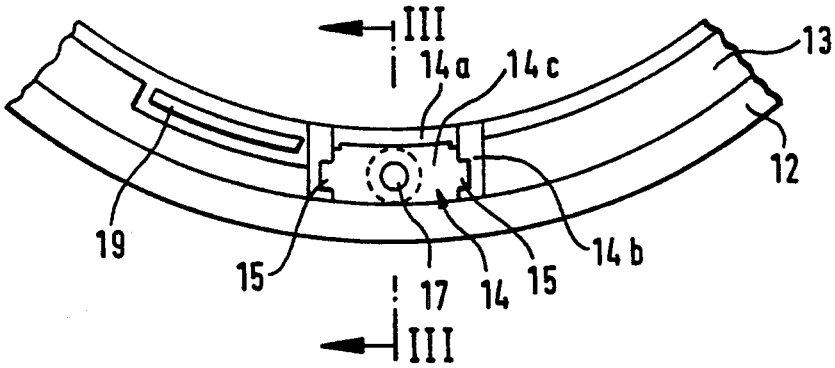
FIG. 2 is a top view of the mounting ring according to FIG. 1.

Spaced about the circumference of the wall section 11 of the mounting ring 10 are several axial recesses or compartments 14 of generally rectangular cross section (only one compartment 14 is depicted in the drawing). As shown in particular in FIG. 2, each compartment 14 is open toward the outside and is defined by a rear wall 14*a*, side walls 14*b* which extend upwardly from the wall section 11 and a bottom 14*c*. Suitably, the side walls 14*b* are backed by a tapered wall section 11*a* to reinforce the compartment 14. The opposing side walls 14*b* extend beyond the rear wall 14*a*, as best seen in FIG. 1, and are each provided with an axial groove 15, with the grooves 15 thus extending beyond the compartment 14.

Extending behind the projection 12 is a circumferential indentation 13 for allowing access to the compartment 14.

Figure 7:
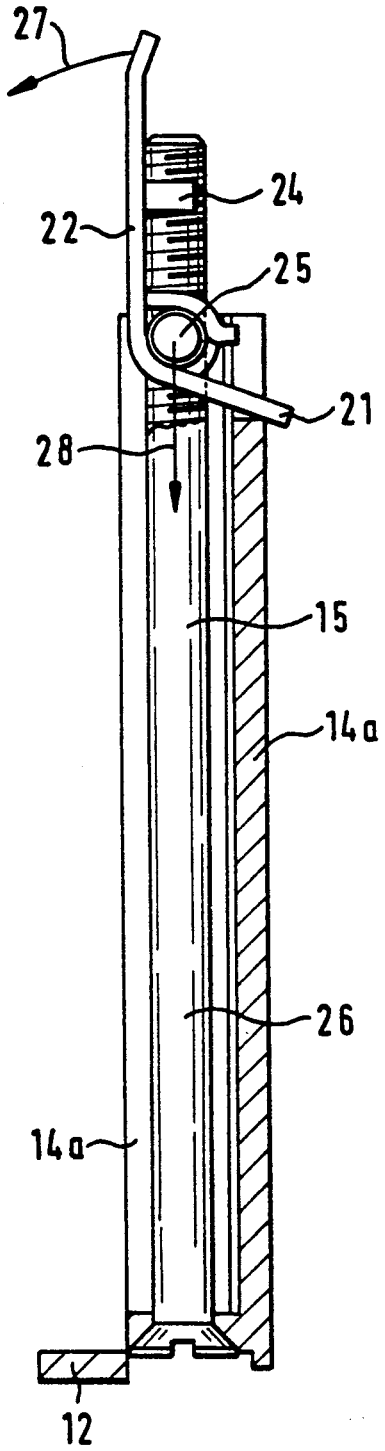
FIG. 7 is a partially sectional view of a mounting ring according to the present invention in combination with a holding element in the initial assembly position before insertion of the mounting ring in a ceiling opening.
Figure 8:
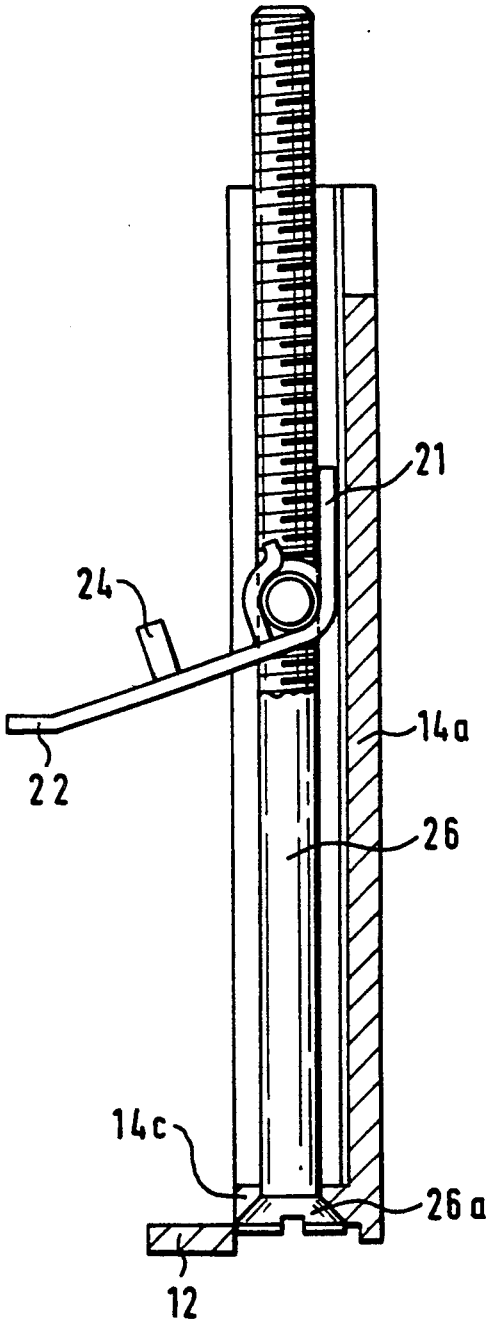
FIG. 8 is a partially sectional view of the mounting ring of FIG. 7, with the holding element in the fastening position for securement of the mounting ring inside the ceiling opening.

The bottom 14*c* of each compartment 14 is provided with a central bore 17 for receiving a spindle 26 which projects through the bore 17 into the compartment 14, with the head 26*a* of the spindle 26 bearing from below upon the bottom 14*c*, as best seen in FIGS. 7 and 8. In this manner, the spindle 26 is accessible from the outside via the indentation 13 so as to allow application of a tool upon the head 26*a* for rotation of the spindle 26 and actuation of a holding element which is suitably attached to the spindle 26 and will now be described in more detail with reference to FIGS. 4, 5 and 6.

FIGS. 4, 5 and 6 show various views of a holding element in accordance with the invention for incorporation in the mounting ring 10. The holding element is provided in form of an angle plate 20 of sheet metal and includes a short leg 21 and a long leg 22. Supported in the vertex of the angle plate 20, i.e. at the junction between the short leg 21 and the long leg 22, is a bolt 25 which has a threaded bore 25*a* (FIG. 6) for receiving the spindle 26. The bolt 25 is rotatably supported in an axle box in form of bushings 23 which are attached to the angle plate 20. At its opposing axial ends, the bolt 25 is provided with journals 25*b* which are engageable in the lateral grooves 15 of the compartment 14 for guiding the angle plate 20 during its vertical displacement along the spindle 26.

Attached at a suitable location to the long leg 22 of the angle plate 20 are two spaced lugs 24 which are slanted toward each other and between which the head distant axial end of the spindle 26 is clamped when the long leg 22 occupies its vertical position i.e. the assembly position of the mounting ring 10 before installation in the ceiling opening, as shown in FIG. 7. In this assembly position, the long leg 22 is oriented coextensive with the spindle 26 which, as previously described, is held between the lugs 24. The short leg 21 rests upon the top edge of the rear wall 14*a*. Thus, the mounting ring 10 can be placed through the ceiling opening of a dropped ceiling plate without any projecting parts interfering with the insertion step. The mounting ring 10 is placed within the ceiling opening until the annular projection 12 bears from below against the ceiling plate.

After placement of the mounting ring 10 in the ceiling opening, the spindle 26 is rotated to pull the bolt 25 with the angle plate 20 downwards. Since the short leg 21 is supported by the rear wall 14*a*, the angle plate 20 is turned by 90° in direction of arrow 27, with the long leg 22 now radially projecting outwards and the short leg 21 bearing against the inside surface of the rear wall 14*a*, as shown in FIG. 8. A further rotation of the spindle 26 forces the angle plate 20 further downwards in direction of arrow 28 until the long leg 22 bears upon the ceiling plate. Since the short leg 21 abuts the rear wall 14*a* and the journals 25*b* are retained in the grooves 15, the angle plate 20 is accurately guided during its downward travel along the spindle 26.

It will be appreciated by persons skilled in the art that the mounting ring 10 is suitably provided with several such compartments 14 and holding elements, e.g. three, which are evenly spaced about the circumference of the wall section 11. Additionally, persons skilled in the art will understand that the mounting ring 10 must be provided with fastening means for attachment of the lighting fixture e.g. in pockets 19, which for sake of simplicity have essentially been omitted from the Figures.

While the invention has been illustrated and described as embodied in a mounting arrangement for recessed lighting fixtures, it is not intended to be limited to the details shown since various modifications and structural changes may be made without departing in any way from the spirit of the present invention.

What is claimed as new and desired to be protected by Letters Patent is set forth in the appended claims

We claim:

1. A mounting arrangement for recessed lighting fixtures, comprising:

a mounting ring insertable in a ceiling opening and having a cylindrical wall section, said wall section includes at least one compartment;

holding means received in said at least one compartment of said wall section for attaching said mounting ring in the ceiling opening, said holding means including an angle plate having a short leg, a long leg and a plurality of bushings, a vertex being formed between said short leg and said long leg, and a bolt rotatably supported in the vertex and the bushings of said angle plate and having axial ends each provided with a journal for engagement in lateral grooves of said at least one compartment; and adjusting means received in a threaded bore of said bolt for moving said holding means between a first position in which said angle plate is pivoted about said bolt such that said long leg extends vertical and coextensive with said adjusting means and said short leg is supported by a top edge of a rear wall of said at least one compartment so as to allow insertion of said mounting ring in the ceiling opening, and a second position in which said short leg bears upon an inside surface of said rear wall and said long leg projects radially outwards from said mounting ring to bear upon a ceiling plate so as to securely fasten said mounting ring in the ceiling opening.

2. The mounting arrangement defined in claim 1 wherein said long leg includes locking elements in form of lugs for engagement with said adjusting means.

3. The mounting arrangement defined in claim 1 wherein said adjusting means is a spindle.

4. The mounting arrangement defined in claim 1 wherein said at least one compartment is of rectangular configuration.

5. The mounting arrangement defined in claim 1 wherein said mounting ring is made of plastic material.

6. The mounting arrangement defined in claim 1 wherein said mounting ring is made of metal.

7. The mounting arrangement defined in claim 1 wherein said angle plate is made of sheet metal.

8. A mounting arrangement for recessed lighting fixtures, comprising:

a mounting ring having a cylindrical wall section, said wall section includes at least one compartment;

holding means received in said at least one compartment of said mounting ring for attaching said mounting ring inside a ceiling, said holding means including an angle plate including a short leg, a long leg and a plurality of bushings, a vertex being formed between said short leg and said long leg and a bolt supported in the vertex and the bushings of said angle plate; and adjusting means connected to said bolt for moving said angle plate between a first position in which said long leg extends coextensive with said adjusting means and said short leg is supported by a top edge of a rear wall of said at least one compartment to allow insertion of said mounting ring in the ceiling and a second position in which said short leg bears against an inside surface of said rear wall and said long leg projects radially outwards from the mounting ring to bear upon a ceiling plate to secure the mounting ring inside the ceiling.

* * * * *